United States Patent [19]

Rossi

[11] 3,943,987

[45] Mar. 16, 1976

[54] RECLOSABLE AIR-TIGHT CONTAINERS WITH EVACUATION MEANS

[76] Inventor: Thomas J. Rossi, 5019 Sentinel Drive, Sumner, Md. 20016

[22] Filed: Oct. 17, 1974

[21] Appl. No.: 515,719

[52] U.S. Cl. ..... 150/.5; 206/808; 312/284; 53/9; 53/22 R; 426/404

[51] Int. Cl.[2] ..... B65D 51/16; B65D 81/20

[58] Field of Search ..... 215/262; 220/231, 367; 206/315, 808; 150/.5; 53/9, 22 R; 312/284; 426/404

[56] References Cited

UNITED STATES PATENTS

| | | | |
|---|---|---|---|
| 1,598,590 | 8/1926 | Staunton | 215/262 |
| 2,890,810 | 6/1959 | Rohling | 220/231 |
| 3,233,727 | 2/1966 | Wilson | 220/367 |
| 3,415,357 | 12/1968 | van Natter | 206/315 |
| 3,511,288 | 5/1970 | Swett et al. | 150/.5 |

*Primary Examiner*—George T. Hall
*Attorney, Agent, or Firm*—B. P. Fishburne, Jr.

[57] ABSTRACT

A container for perishable articles or substances includes a replaceable closure member capable of forming an airtight seal with a body portion of the container. An evacuation valve is provided on the closure member or another accessible part of the container allowing substantially complete evacuation of air trapped therein after closing the container. Means is also provided to relieve the vacuum to facilitate reopening of the container. The invention is applicable to household containers for foodstuffs as well as industrial containers for chemicals, pharmaceuticals and other materials requiring an air-free environment.

2 Claims, 3 Drawing Figures

RECLOSABLE AIR-TIGHT CONTAINERS WITH EVACUATION MEANS

BACKGROUND OF THE INVENTION

A need exists in the home and in certain industries for a reclosable or reusable container having an air-tight closure seal and an attached means to allow the creation of a partial vacuum in the container after reclosing thereof with perishable contents inside. No prior art device to meet this particular need is known, and it is the object of the invention to satisfy the need in connection with several different forms of reclosable containers.

It is known in the prior art to provide a vacuum sealed container for foodstuffs or the like wherein the vacuum is lost when the container or package is initially opened and cannot be re-established due to the absence of any means which would allow this. A typical example of the prior art is the well-known evacuated can for ground coffee, in which the initial opening of the can destroys the vacuum and there is neither an evacuation valve or the like on the container or on its closure, nor any arrangement for rendering the lid or closure air-tight when reapplied to the container body. Similarly, with flexible type vacuum food packages, once the package is ruptured and the vacuum is lost, there is no way to restore it or to reuse the vacuum package. Such packages are not ordinarily of the reclosable type in any case.

Therefore, the essence of this invention provides in providing a reclosable and resealable container having a primary vacuum tight seal which may be re-established on each application of the container closure, and a convenient means such as a check valve on the container closure susceptible of use with a conventional vacuum pump to draw air from the closed container so as to establish a proper vacuum therein to meet the requirements for certain goods held in the container. A means is also provided to vent the vaccum prior to reopening the container. The invention finds utility in the home for cake boxes and the like, mason jars, and other reclosable containers. In the chemicals industry, for example, large or small reclosable vacuum tight containers can similarly be equipped with the invention with minimal expense and no interference with the normal use of the container in instances where evacuation is not needed.

Other features and advantages of the invention will become apparent during the course of the following description.

BRIEF DESCRIPTION OF DRAWING FIGURES

DETAILED DESCRIPTION

Figure 1:
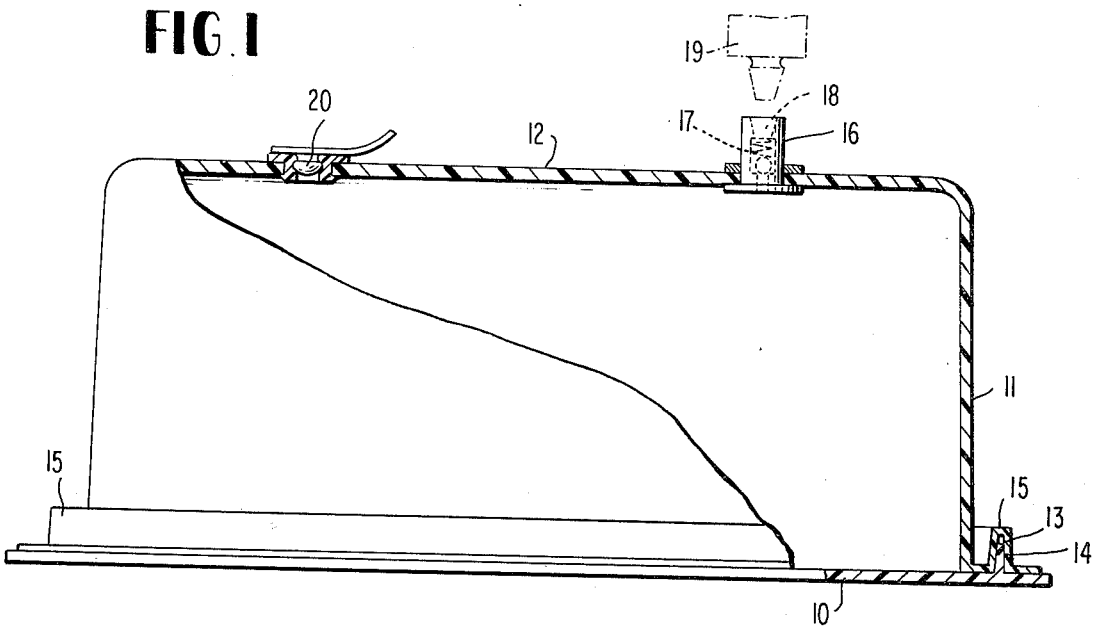
FIG. 1 is a side elevation, partly in cross section, of a cake box or the like equipped with the invention.

Referring to the drawings in detail, wherein like numerals designate like parts and referring first to FIG. 1, the numeral 10 designates the base or plate portion of a plastic cake box of the kind used commonly in the home to preserve the freshness of a layer cake. It should be understood at this point that the invention is not restricted to use on a cake box or any other single form of container, but on the contrary, is applicable to substantially any reclosable container having a primary air-tight seal between the body and the closure thereof.

The container in FIG. 1 further comprises a readily replaceable lid or closure 11 which is domed as shown and includes a flat top wall 12. The plate portion 10 projects outwardly of the side wall of closure 11 and has an integral upstanding annular blade-like flange 13 which is slightly tapered to snugly engage in a downwardly open annular groove 14 formed in an extension 15 of closure member 11 opposite to the flange 13. When the parts 11 and 10 are assembled as shown in FIG. 1, a vacuum-tight or air-tight seal of considerable integrity is formed between the interfitting annular parts 13 and 15. This primary seal structure is well known and is present on a widely used commercial line of plastic containers and need not be further described herein. It is sufficient to state that an essential part of the combination forming the invention is an air-tight or vacuum-tight container of the reusable type in which a closure member can be reapplied any number of times to a base or body portion to re-establish a primary seal, as distinguished from single use containers where the seal is lost upon the first opening of the container and reestablishing of the seal or of a vacuum in the container is not contemplated.

The invention further comprises in FIG. 1 an evacuation valve 16 mounted in a sealed manner on the top wall 12 as shown. The valve 16 may be a conventional one-way closing and one-way opening spring-urged ball check valve or the like, or an equivalent valve means. As illustrated in FIG. 1, the ball valve is biased closed by a spring 17 and will open upon the application of vacuum to a port or mouth 18. Sufficient vacuum to open the valve and remove for practical purposes all air from the container can be created by a conventional hand pump shown at 19. Upon separation of the pump from the valve 16, the same will close automatically to maintain a partial vacuum in the container.

Therefore, when a cake or the like is placed on the plate 10 and covered by the closure 11 and sealed by the means 13–15, there will always be some air trapped in the container which will destroy the freshness of the cake or similar article to some extent. However, when the remaining air is evacuated through the valve 16, freshness of the article is maintainable for a much greater period of time.

To relieve the vacuum in the closed container so that it may be opened without difficulty, a relief means such as a manual plug 20, or an equivalent device, is provided on the container and preferably on the top of its closure, as shown.

Figure 2:
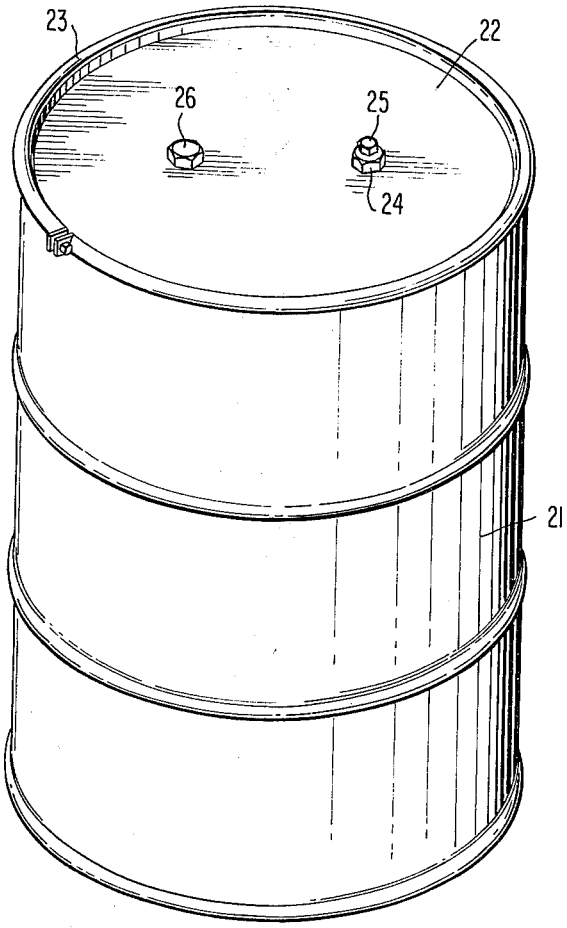
FIG. 2 is a perspective view of an industrial container or drum having the invention applied thereto.

FIG. 2 shows an industrial container on drum 21 having a reclosable lid 22 adapted to be sealed to the drum in a pressure-tight or vacuum-tight manner by a conventional lid clamping ring 23 and an associated gasket means. The drum may contain a variety of chemicals or pharmaceuticals or the like which require the absence of air to resist oxidation, loss of potency and the like. Certain highly corrosive metals require similar handling and no convenient means is available on the present market.

The drum lid 22 is equipped with an evacuation valve 24 similar to the valve 16 and the mouth or opening of the valve 24 is preferably protected by a removal plug 25 in the industrial embodiment. When the protective plug is removed, the normally closed one-way opening check valve 24 is adapted for connection with a suitable vacuum source, not shown. The valve 24 per se is conventional. A separate plug 26 is removably mounted on the closure or lid 22 to relieve the internal vacuum prior to opening the container.

Figure 3:
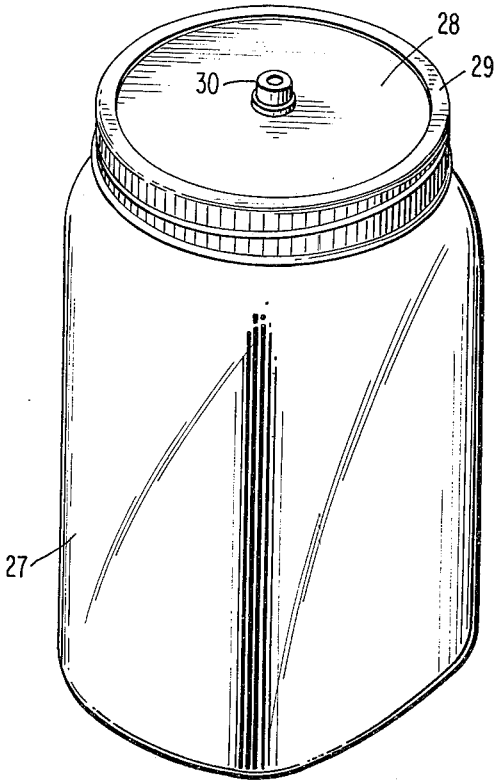
FIG. 3 is a further perspective view showing the invention applied to the lid of a mason jar.

FIG. 3 shows the invention applied to a mason jar 27 having a sealed lid 28 clamped in place on the jar by the usual screw-threaded ring 29. A valve 30, similar to the valve 16, is installed on the lid 28 and is used in the manner previously described to exhaust trapped air from the jar after closing and sealing of its lid. In the case of the mason jar, it is possible to omit the vacuum relief plug as removal of the ring 29 and prying of the lid 28 will be sufficient to break the vacuum.

In all cases, the invention consists of a container body with a vacuum-tight reclosable cover or lid and an associated evacuation valve and a vacuum relieving plug or means. The valve is used to remove air trapped in the container after the closure or cover is placed and sealed. The wide utility of the invention, its simplicity and its economy should now be apparent to anyone skilled in the art.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A reusable and reclosable plastic container for foodstuffs and the like comprising a substantially flat plate body portion having an upstanding continuous blade-like sealing flange near its margin, a separable dome-like cover for the plate body portion having a continuous grooved female sealing element near its margin positioned to receive therein said blade-like sealing flange, whereby said body portion and said cover may be assembled repeatedly and separably in hermetically sealed relationship, an evacuation one-way closing check valve unit on the top of said cover adapted for connection with a vacuum source whereby residual air inside of said container may be exhausted therefrom and a partial vacuum maintained therein, and a vacuum relief element separate from said evacuation check valve unit on said cover to allow the quick relief of the partial vacuum in said container so that the cover can be separated from the plate body portion.

2. The structure of claim 1, and said vacuum relief element comprising a quick release plug element for manual operation on the top of said cover in spaced relation to said evacuation valve unit.

* * * * *